US007294210B2

(12) United States Patent
Church

(10) Patent No.: US 7,294,210 B2
(45) Date of Patent: Nov. 13, 2007

(54) USE OF SUBSTITUTED HYDROXYLAMINES IN METAL PHOSPHATING PROCESSES

(75) Inventor: Richard Church, Berkley, MI (US)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 10/319,115

(22) Filed: Dec. 13, 2002

(65) Prior Publication Data

US 2003/0155042 A1 Aug. 21, 2003

Related U.S. Application Data

(60) Provisional application No. 60/339,342, filed on Dec. 13, 2001, provisional application No. 60/402,216, filed on Aug. 9, 2002.

(51) Int. Cl.
*C23C 22/07* (2006.01)
*C23C 22/12* (2006.01)
*C23C 22/00* (2006.01)

(52) U.S. Cl. ..... 148/253; 148/243; 148/257; 148/259; 148/260; 106/14.05; 106/14.11; 106/14.12; 106/14.15

(58) Field of Classification Search ..... 148/253–263, 148/617, 243; 252/402; 523/122; 106/14.05, 106/14.11, 14.12, 14.15
See application file for complete search history.

(56) References Cited

U.S. PATENT DOCUMENTS

| | | | | |
|---|---|---|---|---|
| 2,298,280 A | | 10/1942 | Clifford et al. | |
| 2,702,768 A | | 2/1955 | Hyams et al. | |
| 2,743,204 A | | 4/1956 | Russell | |
| 2,874,081 A | | 2/1959 | Cavanagh et al. | |
| 2,884,351 A | | 4/1959 | Cavanagh et al. | |
| 3,923,554 A | * | 12/1975 | Ziemba | 148/260 |
| 3,975,214 A | | 8/1976 | Kulick et al. | |
| 4,149,909 A | | 4/1979 | Hamilton | |
| 4,457,790 A | | 7/1984 | Lindert et al. | |
| 4,517,028 A | | 5/1985 | Lindert | |
| 4,547,532 A | * | 10/1985 | Bednarski et al. | 523/122 |
| 4,680,064 A | * | 7/1987 | Portz et al. | 148/260 |
| 4,824,490 A | * | 4/1989 | Oei et al. | 148/259 |
| 4,865,653 A | | 9/1989 | Kramer | |
| 4,941,930 A | | 7/1990 | Charles et al. | |
| 5,143,562 A | | 9/1992 | Boulos | |
| 5,234,509 A | | 8/1993 | Tull | |
| 5,261,973 A | | 11/1993 | Sienkowski et al. | |
| 5,378,292 A | | 1/1995 | Miller et al. | |
| 5,587,109 A | | 12/1996 | Greaves et al. | |
| 5,595,611 A | | 1/1997 | Boulos et al. | |
| 5,597,465 A | | 1/1997 | Pedrazzini | |
| 5,653,790 A | | 8/1997 | Fotinos et al. | |
| 5,714,047 A | | 2/1998 | Pedrazzini | |
| 5,714,118 A | | 2/1998 | Scheurman, III | |
| 5,728,235 A | | 3/1998 | Boulos et al. | |
| 5,797,987 A | | 8/1998 | Rossio | |
| 5,868,874 A | | 2/1999 | Rossio | |
| 5,871,669 A | * | 2/1999 | Tittmann et al. | 252/402 |
| 5,891,268 A | | 4/1999 | Hacias et al. | |
| 6,019,858 A | | 2/2000 | Sienkowski et al. | |
| 6,179,934 B1 | | 1/2001 | Kawakami et al. | |
| 6,197,126 B1 | | 3/2001 | Roland et al. | |
| 6,379,474 B1 | | 4/2002 | Mayer et al. | |
| 6,461,450 B1 | | 10/2002 | Riesop et al. | |

FOREIGN PATENT DOCUMENTS

| | | |
|---|---|---|
| GB | 1 603 934 A | 3/1978 |
| WO | WO 99/45171 | 9/1999 |

OTHER PUBLICATIONS

US 4,983,229, 01/1991, Tull (withdrawn)

* cited by examiner

*Primary Examiner*—Roy King
*Assistant Examiner*—Lois Zheng
(74) *Attorney, Agent, or Firm*—Stephen D. Harper; Mary K. Cameron

(57) ABSTRACT

Alkyl-substituted hydroxylamines are useful as aids in the phosphating of metal substrates. In particular, the rate of phosphating and the rate at which manganese compounds are dissolved into aqueous phosphoric acid solutions may be accelerated by alkyl-substituted hydroxylamines.

18 Claims, No Drawings

USE OF SUBSTITUTED HYDROXYLAMINES IN METAL PHOSPHATING PROCESSES

This application claims priority from U.S. provisional application Ser. No. 60/339,342, filed 13 Dec. 2001, and U.S. provisional application Ser. No. 60/402,216, filed 9 Aug. 2002, each of which is incorporated herein by reference in its entirety.

BACKGROUND OF INVENTION

1. Field of Invention

The invention relates to compositions and processes for depositing phosphate-containing conversion coatings, such as zinc phosphate and iron phosphate conversion coatings, on metal surfaces. In particular, the invention pertains to the use of substituted hydroxylamines as accelerators in zinc and iron phosphating processes and as dissolution aids in the preparation of manganese phosphate conversion coating compositions.

2. Statement of Related Art

The general process of phosphate conversion coating is well known in the art; such processes are commonly used to impart corrosion resistance to metal surfaces. Contacting active metals with aqueous acidic compositions containing zinc and phosphate ions, for example, results in the deposition on the active metal surfaces of a conversion coating containing zinc phosphate. If the active metal is ferrous, iron phosphates are usually included in the coating, and in modern practice nickel and/or manganese are often included in the coating composition and thereby in the coating formed. If alkali metal and/or ammonium cations rather than zinc cations are present in the coating composition, an iron phosphate conversion coating is formed on the metal surface. In order to speed the conversion coating process, lower the phosphating temperature, and/or improve the uniformity or quality of the coating, it is customary to include in the coating composition a component called an "accelerator" that does not usually become incorporated into the coating formed. Typical widely used accelerators include nitrate and nitrite ions, chlorate, soluble nitroaromatic organic compounds such as p-nitrobenzene sulfonic acid and hydroxylamine and its salts (e.g., hydroxylamine sulfate).

Although the most widely used accelerator in current commercial practice is believed to be nitrite, hydroxylamine and its salts have in recent years become more frequently employed in metal phosphating processes. Unfortunately, however, hydroxylamine is now under investigation as a possible carcinogen. If the carcinogenity of hydroxylamine is confirmed, this is likely to lead to stricter regulations and controls on the use and disposal of this substance and perhaps even a complete ban on its production and/or use in certain localities.

It would therefore be very desirable to develop alternative phosphating systems which use accelerators other than hydroxylamine but which provide conversion coatings of at least comparable quality.

SUMMARY OF THE INVENTION

Substituted hydroxylamines have now been found to be satisfactory accelerators for phosphate conversion coating compositions.

The invention thus provides a working phosphate conversion coating composition which is acidic and which is comprised of:

a) water;

b) cations selected from zinc cations, alkali metal cations, ammonium cations, or mixtures thereof;

c) phosphate ions; and d) a water-soluble substituted hydroxylamine corresponding to general formula

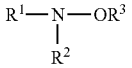

or a salt thereof wherein $R^1$, $R^2$ and $R^3$ are the same or different and are independently selected from H and $C_1$-$C_6$ alkyl (straight chain, branched or cyclic), subject to the proviso that $R^1$, $R^2$ and $R^3$ are not all H (i.e., that at least one of $R^1$, $R^2$, or $R^3$ is a $C_1$-$C_6$ alkyl group).

In one embodiment of the invention, at least one of $R^1$ or $R^2$ in the foregoing general formula is a $C_1$ to $C_6$ alkyl group. In another embodiment of the invention, both $R^1$ and $R^2$ are $C_1$ to $C_6$ alkyl groups, which may be the same or different.

The invention also provides an aqueous liquid make-up concentrate suitable for dilution with water to form the above-described working phosphate conversion coating composition, said concentrate comprising components b), c), and d) described above in concentrations higher than that desired in the working composition.

The invention also provides an aqueous liquid replenisher concentrate composition suitable for replenishing the above-described working phosphate conversion coating composition after it has been used for a period of time to form metal phosphate conversion coatings on metallic substrates, said aqueous liquid replenisher concentrate composition comprising components b), c), and d) described above.

The invention also provides a process for producing a phosphate conversion coating on a surface of a metallic substrate, said process comprising contacting said surface with the above-described working phosphate conversion coating composition.

The invention also provides a method of preparing a manganese phosphate conversion coating composition comprising dissolving a manganese compound such as manganese (II) oxide in an aqueous phosphoric acid solution in the presence of a water-soluble substituted hydroxylamine or salt thereof.

DETAILED DESCRIPTION OF THE INVENTION

The substituted hydroxylamine used in the present invention should be water-soluble and may be selected from compounds containing at least one N—O functional group and at least one alkyl group substituted on the nitrogen atom and/or oxygen atom. The nitrogen atom may bear two alkyl groups. Preferably, the alkyl groups contain from 1 to 6 carbon atoms. Alkyl groups may be selected from methyl, ethyl, n-propyl, tert-butyl, iso-propyl, n-butyl, sec-butyl, and the like. If the hydroxylamine is substituted with more than one alkyl group, the alkyl groups may be the same or different. Mixtures of different substituted hydroxylamines may be utilized, if so desired. Salts of the substituted hydroxylamines may be used such as, for example, the sulfate, nitrate, hydrohalide, and phosphate salts. The substituted hydroxylamine may be utilized as the sole accelerator in the working phosphate conversion coating composition or in combination with other accelerators.

Specific preferred substituted hydroxylamines include N-isopropyl hydroxylamine and N,N-diethyl hydroxylamine.

Any of the known working phosphate conversion coating compositions, aqueous liquid make-up concentrates, and aqueous liquid replenisher concentrate compositions which contain hydroxylamine or a salt thereof may be modified by replacing all or at least a portion of the hydroxylamine (or hydroxylamine salt) with at least one of the aforedescribed substituted hydroxylamines and/or substituted hydroxylamine salts. In general, replacement with an equivalent (i.e., equimolar) amount of the substituted hydroxylamines of the present invention will provide satisfactory results, although to achieve optimum performance it may be necessary to adjust the concentration of the substituted hydroxylamine somewhat from the equivalent level, depending on the activity and other characteristics of the particular substituted hydroxylamine(s) used. Such optimization may be readily accomplished by standard experimental methods (e.g. by varying the concentration of the substituted hydroxylamine over a range and measuring the correlation of one or more properties of the resulting conversion coating with the substituted hydroxylamine concentration). In some embodiments of the invention, a substituted hydroxylamine may be used to replace a conventional hydroxylamine or hydroxylamine sulfate accelerator at a significantly reduced concentration (on a molar basis) without compromising the ability of the working phosphate conversion coating composition to rapidly form a high quality phosphate coating on a metallic substrate.

The following United States patents related to hydroxylamine-containing phosphate compositions and the use of such compositions to form zinc phosphate conversion coatings on metallic substrates are all incorporated herein by reference in their entirety:

U.S. Pat. Nos. 2,743,204
2,298,280
5,547,465
5,234,509
5,868,874
5,797,987
5,714,047
5,378,292
4,865,653
5,261,973
6,019,858
6,197,126
6,179,934
5,653,790
5,143,562
4,941,930
4,983,229

The following United States patents related to hydroxylamine-containing phosphate compositions and the use of such compositions to form iron phosphate conversion coatings are all incorporated herein by reference in their entirety:

U.S. Pat. Nos. 4,149,909
5,891,268
2,298,280

The working phosphate conversion coating composition must be acidic and preferably (where formation of a zinc phosphate conversion coating is desired) has a total acid content of from about 10 points to about 100 points (as measured by titrating a 5.0 ml sample with 0.1 N NaOH to phenolphthalein endpoint, total acid points being equal to the number of milliliters of 0.1 N NaOH needed to reach the endpoint).

The components and component concentrations present in the working phosphate conversion coating composition as well as the phosphating conditions may be varied as desired depending upon the intended end use of the conversion coated-metallic substrate, consistent with customary practice in the field. For example, the present invention may be used to prepare zinc phosphate conversion coatings which are to be used as bases for paint or which are to be used as bases for lubricant prior to cold forming of the metallic substrate.

Preferred phosphate levels useful in the working phosphate conversion coating compositions of the present invention are typically in the range of from about 0.5 to about 8.0 weight %, preferably about 1.0 to about 7.0 weight %. The source of phosphate may be phosphoric acid, condensed phosphoric acids, and the salts of such phosphorus oxyacids. Where an iron phosphate conversion coating is desired, typically alkali metal and/or ammonium salts of phosphoric acid and other phosphorus oxyacids are utilized.

Where a zinc phosphate conversion coating is desired, the zinc ion content of the working phosphate conversion coating composition may vary widely in accordance with standard practice in the zinc phosphating art and is typically between about 0.02 to about 7.5 weight %. Where the zinc phosphate conversion coating is to be used as a base for cold forming (wherein a lubricant is applied to the conversion coated-substrate), zinc concentrations at the higher end of this range (e.g., 0.25 weight % to 7.5 weight %) are preferred. Where the zinc phosphate conversion coating is to be used as a surface treatment prior to application of one or more layers of paint, primer, or the like, zinc concentrations at the lower end of this range (e.g., 0.05 to 0.3 weight %) are preferred. The source of the zinc ion may be conventional zinc ion sources, such as zinc nitrate, zinc oxide, zinc carbonate, zinc metal, and the like.

The substituted hydroxylamine is present in the working phosphate conversion coating composition in an amount sufficient to accelerate the formation of the phosphate conversion coating (as compared to the rate of coating formation in the absence of the substituted hydroxylamine or salt thereof) and is usually added in an amount of about 1 to about 200 mmoles/L, preferably between about 2 to about 50 mmoles/L.

In addition to water, zinc and/or alkali metal and/or ammonium cations, phosphate ions and substituted hydroxylamine(s), the working phosphate conversion coating compositions may contain fluoride ions, nitrate ions (as supplied by nitric acid or nickel nitrate, for example), and various metal ions, such as nickel ions, cobalt ions, calcium ions, magnesium ions, manganese ions, iron ions, and the like. When present, nitrate ion may be in an amount of about 0.5 to about 10 weight %, preferably in some embodiments of the invention between about 1.0 to about 7.5 weight %. When present, nickel ion may be in an amount of about 0.001 to about 0.05 weight %, preferably about 0.002 to about 0.02 weight %, and more preferably between about 0.004 to about 0.01 weight %.

The working phosphate conversion coating composition of the present invention can be prepared fresh with the above mentioned ingredients in the concentrations specified or can be prepared in the form of aqueous concentrates in which the concentrations of the various ingredients are considerably higher. Concentrates are generally prepared beforehand and shipped to the application site where they are diluted with an aqueous medium such as water or are diluted by feeding them into a phosphating composition which has been used for some time. Concentrates are a practical way of replacing the active ingredients of a phosphating bath. The concentrates of the present invention thus are useful as replenishers.

In a particularly preferred embodiment of the invention, the concentrates for the working phosphate conversion coating compositions or the working phosphate conversion coating compositions are additionally comprised of one or more compounds capable of stabilizing the substituted hydroxylamine. Practice of this embodiment of the invention is especially preferred where the phosphating is carried out "on the iron side". In the absence of such stabilizers, the substituted hydroxylamine may be susceptible to decomposition, especially at elevated temperatures. A stabilizer inhibits decomposition of the substituted hydroxylamine, thus reducing the need to periodically add substituted hydroxylamine to a working bath to maintain an effective level of the substituted hydroxylamine (i.e., a concentration sufficient to accelerate formation of the desired high quality phosphate conversion coating on the metallic substrate surface). Suitable effective stabilizers include, for example, compounds containing one or more —$C(O)NH_2$ or —$S(O)_2NH_2$ moieties such as urea and sulfamic acid. The use of sulfamic acid is especially preferred. Although urea also effectively stabilizes the substituted hydroxylamine, a working phosphate conversion coating composition containing sulfamic acid generally exhibits a significantly longer useful life than when urea is used as the stabilizer (as measured by the production of uniform, complete conversion coatings on a metallic substrate).

In the aforedescribed embodiment of the invention, an amount of stabilizer is present in the concentrate which is effective to inhibit the rate of substituted hydroxylamine decomposition as compared to the rate in the absence of stabilizer. The optimum stabilizer concentration will depend upon a number of factors, but can be readily determined by standard experimental methods. Typically, the mole ratio of stabilizer:substituted hydroxylamine will be from about 0.05:1 to about 1.2:1 (preferably, from about 0.3:1 to about 0.8:1). The working phosphate conversion coating composition will generally contain from about 0.005 to about 0.05 percent stabilizer on a weight/volume basis.

An additional advantage of including a stabilizer in the working phosphate conversion coating composition of the present invention is that as the working bath is aged, the zinc phosphate coating weight obtained is generally higher than the coating weight obtained using an aged working bath that contains a conventional hydroxylamine sulfate accelerator rather than a substituted hydroxylamine.

Illustrative formulations for typical working phosphate conversion coating compositions prepared from concentrates containing a sulfamic acid stabilizer are as follows:

| Component | Concentration |
|---|---|
| Zn | 1.8–2.2 wt % |
| Ni | 50–70 ppm |
| Phosphate | 2.7–3.3 wt % |
| Nitrate | 3.2–3.8 wt % |
| Diethyl Hydroxylamine | 0.02–0.05 wt % |
| Sulfamic Acid | 0.015–0.025 wt % |

pH = about 1 to about 2

The working phosphate conversion coating composition of the present invention is usable to coat metal substrates composed of various metal compositions, such as ferrous metals, steel, galvanized steel, or steel alloys, zinc or zinc alloys, and other metal compositions such as aluminum or aluminum alloys. Typically a substrate such as an automobile body will have more than one metal or alloy associated with it and the metal phosphate coating compositions of the present invention are particularly useful in coating such substrates.

The working phosphate conversion coating composition of the present invention may be applied to a metal substrate by known application techniques, such as dipping, spraying, intermittent spraying, dipping followed by spraying, and spraying followed by dipping. Typically, the phosphate conversion coating composition is applied to the metal substrate at temperatures of about 90° F. to 210° F. The contact time for the application of the phosphate conversion coating composition is generally between about 0.5 to 10 minutes.

It will also be appreciated that certain other steps may be done both prior to and after the application of the coating by the processes of the present invention. For example, the substrate being coated is preferably first cleaned or degreased to remove grease, dirt, or other extraneous matter. This is usually done by employing conventional cleaning procedures and materials. These would include, for example, mild or strong alkali cleaners, acidic cleaners, and the like. Such cleaners are generally followed and/or preceded by a water rinse.

Where a zinc phosphate conversion coating is to be used as a paint base in automotive or appliance applications, it is preferred to employ a conditioning step following or as part of the cleaning step, as disclosed for instance in U.S. Pat. Nos. 2,874,081 and 2,884,351. The conditioning step may, for example, involve application of a condensed titanium phosphate solution to the metal substrate. After the zinc phosphate conversion coating is formed, it is advantageous to subject the coating to a post-treatment rinse to seal the coating and improve performance. The rinse composition may contain chromium (trivalent and/or hexavalent) or may be chromium-free. Chromium post-treatment would include, for example, about 0.005 to about 0.1 percent by weight of chromium. Chromium-free rinses typically contain organic materials (e.g., polymers such as polyvinyl phenols or derivatives thereof) and/or zirconium compounds and may also be employed. For example, see U.S. Pat. Nos. 3,975,214; 4,457,790; and 4,517,028.

Where a zinc phosphate conversion coating is to be used as a lubricant base in a cold forming operation, it is preferred to use the following sequence of process steps:

1. Clean (typically with an aqueous alkaline cleaner)
2. Rinse with hot water
3. Pickle (typically with an aqueous acid solution)
4. Rinse with cold water
5. Phosphate using the working phosphate conversion coating compositions of the present invention
6. Rinse with cold water
7. Neutralize to remove residual surface acidity (for example, with PARCOLENE 21A neutralizer, available from the Surface Technologies division of Henkel Corporation)
8. Apply lubricant (for example, a soap-based lubricant)
9. Dry (by baking or flash drying, for example)

In another aspect of the invention, one or more substituted hydroxylamines are used to accelerate the dissolution rate of MnO and other such manganese compounds which are ordinarily slow to dissolve in aqueous solutions of phosphoric acid. Manganese (II) oxide and similar compounds are commonly employed as sources of dissolved manganese cations in the preparation of manganese phosphate conversion coating compositions, as described for example in U.S.

Pat. Nos. 5,595,611 and 5,728,235 (each of which is incorporated herein by reference in its entirety). It has now been found that substituted hydroxylamines as described herein are effective as catalysts or accelerants for the dissolution of manganese compounds such as MnO in aqueous phosphoric acid solutions. In preparing such solutions, the ratio of the molar concentration of substituted hydroxylamine to the molar concentration of the manganese compound (e.g., MnO) is preferably at least 0.01:1 (more preferably, at least 0.1:1) and independently preferably is (primarily for reasons of economy) not more than 1:1 (more preferably, not more than 0.3:1), although the optimal ratio may vary somewhat from the aforestated ratios depending upon the particular substituted hydroxylamine and dissolution conditions selected.

EXAMPLES

Four aqueous acidic phosphating baths were prepared containing 2.7 weight % Zn, 3.6 weight % nitrate, 3.3 weight % phosphate, 0.0067 weight % Ni, and 7.3 mmoles/kg of either hydroxylamine, hydroxylamine sulfate, N-isopropyl hydroxylamine (a 15% solution commercially available as "IPHA I-15" from Angus Chemical Co.), or N, N-diethyl hydroxylamine (an 85% solution commercially available as "Pennstop, 85%" from Atofina Chemicals, Inc.). The total acid content of each phosphating bath was about 40 points (5 ml bath sample titrated to a phenolphthalein endpoint with 0.1 N NaOH).

Each bath was aged with cold rolled steel (CRS) panels at a rate of 3 $ft^2$/gal/hour until a total throughout of 90 $ft^2$/gal was reached. The process sequence for the panels was as follows:

1. Clean using Parcoclean® 2077X (a product of the Surface Technologies division of Henkel Corporation) at a concentration of 4 oz/gal, 190° F., 5 min.
2. Rinse with hot water, ca. 140° F., 30 sec.
3. Pickle with sulfuric acid at a 10% v/v concentration, 160° F., 5 min.
4. Rinse with cold water, 30 sec
5. Immerse in phosphating bath, 180° F., 5 min.

Specimens for coating weight and SEM/X-ray analysis were saved at 0, 31, 61, and 91 $ft^2$/gal. Throughout the aging study, total acid was maintained at about 40 points by additions of a replenisher containing the same active components as the starting phosphate bath (except for accelerator). Iron and accelerator concentrations were monitored and accelerator directly replenished, as needed.

The phosphating baths containing diethyl hydroxylamine or isopropyl hydroxylamine accelerator generally gave lower coating weights than the phosphating baths containing hydroxylamine or hydroxylamine sulfate. The rates of iron build up over the course of the study for each of the different accelerators were comparable. Replenisher consumptions for each phosphating bath were also quite similar. The average accelerator consumptions for the baths containing hydroxylamine, hydroxylamine sulfate, or diethyl hydroxylamine as accelerator were comparable, but accelerator consumption was significantly lower in the bath containing isopropyl hydroxylamine. Photographs of the coated panels taken using SEM showed that similar starting and ending crystal morphologies were obtained from the phosphating baths containing hydroxylamine, hydroxylamine sulfate, or isopropyl hydroxylamine as accelerator (fresh bath—smooth, rounded crystals; aged bath-jagged, squared crystals). The aged bath containing diethyl hydroxylamine accelerator, however, produced surface crystals having a different, more dendrite morphology.

The X-ray spectra confirmed that the compositions of the coating obtained using either hydroxylamine, hydroxylamine sulfate, or isopropyl hydroxylamine accelerator were similar (fresh bath—ca. 7-8 wt % Fe content; aged bath—ca. 16-18 wt % Fe content). The aged phosphating bath containing diethyl hydroxylamine produced coatings having a somewhat lower iron content (ca. 14 wt. % Fe).

What is claimed is:

1. A phosphate conversion coating composition which is acidic and which is comprised of:

a) water;

b) cations selected from zinc cations, alkali metal cations, ammonium cations or mixtures thereof;

c) phosphate ions; and d) a water-soluble substituted hydroxylamine corresponding to general formula

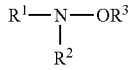

wherein $R^1$, $R^2$ and $R^3$ are the same or different and are independently selected from H and $C_1$-$C_6$ alkyl, subject to the proviso that $R^1$, $R^2$ and $R^3$ are not all H, or a salt of said water-soluble substituted hydroxylamine;

said phosphate conversion coating composition having a total acid content of from about 10 points to about 100 points.

2. The phosphate conversion coating composition of claim 1 comprising zinc cations.

3. The phosphate conversion coating composition of claim 1 additionally comprising at least one stabilizer containing at least one moiety selected from —C(O)$NH_2$ or —S(O)$_2NH_2$ per molecule.

4. The zinc phosphate conversion coating composition of claim 3 wherein the stabilizer is present in an amount such that the mole ratio of stabilizer to substituted hydroxylamine is from about 0.05:1 to about 1.2:1.

5. The phosphate conversion coating composition of claim 1 wherein at least one of $R^1$ or $R^2$ is $C_1$-$C_6$ alkyl.

6. The phosphate conversion coating composition of claim 1 wherein $R^1$ and $R^2$ are the same or different and are both $C_1$-$C_6$ alkyl and $R^3$ is H.

7. The phosphate conversion coating composition of claim 1 wherein $R^1$ and $R^2$ are ethyl and $R^3$ is H.

8. The phosphate conversion coating composition of claim 1 wherein $R^1$ and $R^3$ are H and $R^2$ is isopropyl.

9. The phosphate conversion coating composition of claim 1 wherein said water-soluble substituted hydroxylamine is present at a concentration of about 1 to about 200 mmoles/L.

10. A zinc phosphate conversion coating composition which is acidic and which comprises:

a). water;

b). zinc cations;

c). phosphate ions; and d). 1 to 200 mmoles/L of a substituted hydroxylamine selected from N-isopropyl hydroxylamine, N,N-diethyl hydroxylamine, salts thereof or mixtures thereof.

11. The zinc phosphate conversion coating composition of claim 10 comprising 0.05 to 7.5 weight % zinc cations, 0.5 to 8.0 weight % phosphate ions, and 1 to 200 mmoles/L substituted hydroxylamine selected from N-isopropyl hydroxylamine, N,N-diethyl hydroxylamine, salts thereof or mixtures thereof.

12. The zinc phosphate conversion coating composition of claim 10 additionally comprising sulfamic acid.

13. The zinc phosphate conversion coating composition of claim 12 wherein the sulfamic acid is present in en amount such that the mole ratio of sulfamic acid to substituted hydroxylamine is from about 0.05:1 to about 1.2:1.

14. The zinc phosphate conversion coating composition of claim 10 additionally comprising nickel cations.

15. The zinc phosphate conversion coating composition of claim 10 additionally comprising nitrate anions.

16. A zinc phosphate conversion coating composition having a pH of 1 to 2 and comprising:

a). water;

b). 1.8 to 2.2 weight % zinc cations;

c). 2.7 to 3.3 weight % phosphate ions;

d). 0.02 to 0.05 weight % N,N-diethyl hydroxylamine or salt thereof;

e). 50 to 70 ppm Ni:

f). 3.2-3.8 weight % nitrate; and g). 0.015 to 0.025 weight % sulfamic acid.

17. A phosphate conversion coating composition comprising:

a) water;

b) cations selected from zinc cations, alkali metal cations, ammonium cations or mixtures thereof;

c) phosphate ions; and d) a water-soluble substituted hydroxylamine corresponding to general formula

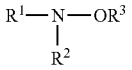

wherein $R^1$, $R^2$ and $R^3$ the same or different and are independently selected from H and $C_1$-$C_6$ alkyl, subject to the proviso that $R^1$, $R^2$ and $R^3$ not all H, or a salt of said water-soluble substituted hydroxylamine;

e) optionally, fluoride ions and/or nitrate ions;

f) optionally, additional metal ions selected from nickel ions, cobalt ions, calcium ions, magnesium ions, manganese ions, iron ions and mixtures thereof.

18. The phosphate conversion coating composition of claim 17 comprising 1 to 200 mmoles/L water-soluble substituted hydroxylamine selected from N-isopropyl hydroxylamine, N,N-diethyl hydroxylamine, salts thereof or mixtures thereof.

* * * * *

UNITED STATES PATENT AND TRADEMARK OFFICE

CERTIFICATE OF CORRECTION

PATENT NO. : 7,294,210 B2
APPLICATION NO. : 10/319115
DATED : November 13, 2007
INVENTOR(S) : Richard Church It is certified that error appears in the above-identified patent and that said Letters Patent is hereby corrected as shown below:

Column 9, line 7, delete “en” and insert therefor --an--.

Column 10, line 13, after “$R^3$” insert --are--.

Signed and Sealed this

Thirteenth Day of May, 2008

JON W. DUDAS
*Director of the United States Patent and Trademark Office*